US010567891B1

(12) United States Patent
Stewart et al.

(10) Patent No.: US 10,567,891 B1
(45) Date of Patent: Feb. 18, 2020

(54) EAR-WEARABLE DEVICE HAVING TUNNEL WITH RECEIVER COIL

(71) Applicant: Starkey Laboratories, Inc., Eden Prairie, MN (US)

(72) Inventors: Jay Stewart, Eden Prairie, MN (US); Michael Karl Sacha, Chanhassen, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 16/213,672

(22) Filed: Dec. 7, 2018

(51) Int. Cl.
*H04R 25/00* (2006.01)

(52) U.S. Cl.
CPC ..... *H04R 25/602* (2013.01); *H04R 25/604* (2013.01); *H04R 25/65* (2013.01); *H04R 2225/025* (2013.01); *H04R 2225/33* (2013.01)

(58) Field of Classification Search
CPC .... H04R 25/602; H04R 25/604; H04R 25/65; H04R 2225/025; H04R 2225/33
USPC ..... 381/323
See application file for complete search history.

(56) References Cited

U.S. PATENT DOCUMENTS

| | | | | |
|---|---|---|---|---|
| 8,953,827 | B2 * | 2/2015 | Sacha | H04R 25/55 381/315 |
| 9,819,075 | B2 | 11/2017 | Kerselaers et al. | |
| 10,390,154 | B2 * | 8/2019 | Spearman | H04R 9/041 |
| 2005/0244024 | A1 * | 11/2005 | Fischer | H04R 25/554 381/331 |
| 2008/0304686 | A1 * | 12/2008 | Meskens | A61N 1/08 381/330 |

OTHER PUBLICATIONS

U.S. Appl. No. 16/213,719, filed Dec. 7, 2018, by Higgins et al.

* cited by examiner

*Primary Examiner* — Phylesha Dabney
(74) *Attorney, Agent, or Firm* — Shumaker & Sieffert, P.A.

(57) ABSTRACT

An ear-wearable device includes a shell shaped for wearing in a user's ear. The shell comprises a tunnel wall shaped to define a tunnel that passes through the ear-wearable device. The ear-wearable device includes a receiver coil that is formed in or around the tunnel wall of the tunnel. The receiver coil is configured to inductively couple with a power coil via the tunnel and to inductively receive electromagnetic power from the power coil, and the receiver coil is configured to convert the electromagnetic power to an electrical current. The ear-wearable device includes one or more electrical components encased within the shell and configured to receive the electrical current from the receiver coil.

14 Claims, 6 Drawing Sheets

EAR-WEARABLE DEVICE HAVING TUNNEL WITH RECEIVER COIL

TECHNICAL FIELD

This disclosure relates to ear-wearable devices.

BACKGROUND

An ear-wearable device is a device designed to be worn on or in a user's ear. Example types of ear-wearable devices include hearing aids, earphones, earbuds, telephone earpieces, and other types of devices designed to be worn on or in a user's ear.

In-ear wearable devices are ear-wearable devices designed to be worn at least partially in the user's ear canal. For example, Invisible-In-The-Canal (IIC) hearing aids, Completely-In-Canal (CIC) hearing aids, In-The-Canal (ITC) hearing aids, In-The-Ear (ITE) hearing aids, and the receiver portions of Receiver-In-Canal (RIC) hearing aids are designed to be worn in the user's ear canals. One advantage of in-ear wearable devices over other types of ear-wearable devices is that in-ear wearable devices may be less visible than other types of ear-wearable devices.

Because an in-ear wearable device is worn in a user's ear canal, the in-ear wearable device may need to have a vent that allows sound generated within the user's head (e.g., the user's voice, chewing sounds, etc.) to escape the user's ear canal instead of being trapped and resonating within the user's ear canal. The user may experience discomfort when such internally generated sounds resonate in the user's ear canal.

SUMMARY

This disclosure describes an ear-wearable device having a shell shaped to define a tunnel, such as a vent, that passes through the ear-wearable device. A receiver coil is formed in or around the tunnel wall of the tunnel, and inductively couples to a power coil to inductively receive electromagnetic power from the power coil and convert the electromagnetic power to an electrical current to charge a battery. The receiver coil inductively couples to the power coil via the tunnel (e.g., in response to the power coil being inserted into the tunnel).

In this manner, the example techniques leverage the tunnel as a location to include the receiver coil so that additional real estate within the ear-wearable device is not needed to place the receiver coil. Moreover, because the power coil is inserted within the tunnel in which or around which the receiver coil is formed, the efficiency of inductive coupling is relatively high. Accordingly, there is relatively low level of loss in the conversion of the electromagnetic power to electrical current, resulting in higher amplitude electrical current being delivered to the battery for faster charging as compared to other techniques.

In one example, this disclosure describes an ear-wearable device comprising a shell shaped for wearing in an ear of a user, wherein the shell comprises a tunnel wall that defines a tunnel, a receiver coil that is formed in or around the tunnel wall of the tunnel, wherein the receiver coil is configured to inductively couple with a power coil via the tunnel and to inductively receive electromagnetic power from the power coil, and wherein the receiver coil is configured to convert the electromagnetic power to an electrical current, and one or more electrical components encased within the shell and configured to receive the electrical current from the receiver coil.

The details of one or more aspects of the disclosure are set forth in the accompanying drawings and the description below. Other features, objects, and advantages of the techniques described in this disclosure will be apparent from the description, drawings, and claims.

DETAILED DESCRIPTION

Figure 1:
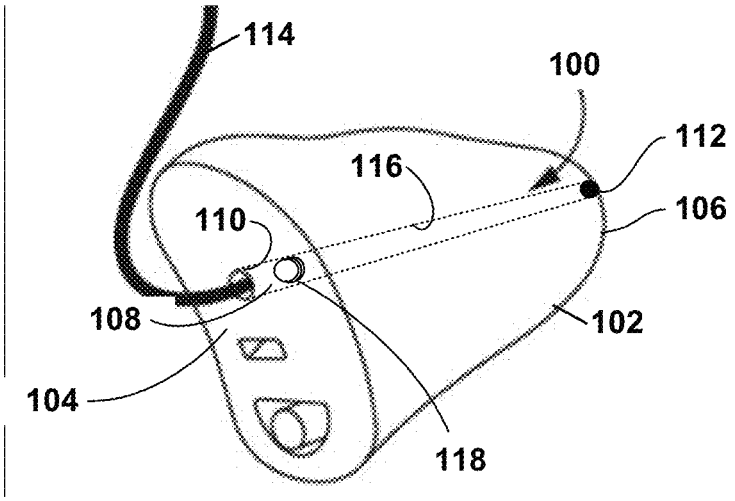
FIG. 1 illustrates an example ear-wearable device in accordance with one or more techniques of this disclosure.

An ear-wearable device may contain a rechargeable battery that provides electrical energy to various electronic components of the in-ear wearable device. Additionally, it may be desirable for in-ear wearable devices to have cable-based communication capabilities. However, attaching power and communication cables to in-ear wearable devices has proven to be challenging. Many ear-wearable devices are tailored to fit the unique anatomical shapes of individual users' ear canals. The resulting variability in the size and shape of in-ear wearable devices may make it difficult to design places to attach cables to the in-ear wearable devices. Additionally, in prior ear-wearable devices, attachment points of such cables may involve moving parts that are susceptible to debris or water intrusion and may be prone to mechanical fatigue.

As noted above, many ear-wearable devices may have vents that allow internally-generated sound to exit the user's ear canal from portions of users' ear canals medial to the ear-wearable devices and the outside environment. Thus, an ear-wearable device may have a shell molded for wear in an ear of a user. For instance, the shell may be shaped such that at least a portion of the shell may be inserted into an ear canal of an ear of the user. The shell has a lateral surface and a medial surface. The lateral surface of the shell is distal to a midline of the user when the ear-wearable device is worn by the user. The medial surface of the shell is proximal to the midline of the user when the ear-wearable device is won by the user. Furthermore, the shell has a tunnel wall. The tunnel wall is a portion of the shell shaped to define a tunnel that passes through the in-ear wearable device from the lateral surface of the shell to the medial surface of the shell and is open at both the lateral surface of the shell and the medial surface of the shell.

In accordance with the techniques of this disclosure, the tunnel may additionally function as a location for a receiver coil that is configured to inductively receive electromagnetic power that the receiver coil converts to an electrical current for charging the battery or for communication. For instance, the receiver coil may be formed in or around the tunnel wall that defines the tunnel. A power coil may be inserted into the tunnel and coupled to a power source. The electrical current from the power source flows through the power coil and radiates out from the power coil as electromagnetic power. The receiver coil inductively receives the electromagnetic power, converts the electromagnetic power to an electrical current. As another example, the power coil carries electrical current modulated based on data to be transmitted, and radiates electromagnetic power based on the modulated electrical current. The receiver coil converts the electromagnetic power into an electrical current modulated based on the data.

As described above, an ear-wearable device may be configured to include a vent to allow internally-generated sound to exit the user's ear canal. By leveraging the vent as the location for the receiver coil, additional space within the ear-wearable device is not needed to house the receiver coil. Moreover, because the power coil is inserted into the tunnel in which or around which the receiver coil is formed, the power coil and receiver coil are proximate to one another. In some examples, the tunnel is a vent that goes through the ear-wearable device. However, the techniques are not so limited. In some examples, the tunnel may not be vent because the tunnel does not go through from the ear canal to outside the ear canal when worn by the user.

For example, a distance separating the coils of the power coil and the coils of the receiver coil when the power coil is inserted into the tunnel may be approximately 0.1 mm to 11 mm, and generally less than 1.5 mm. Due to the relatively small distance between the power coil and receiver coil, when the power coil is inserted, the receiver coil may be configured to inductively receive a substantial amount of the electromagnetic power that the power coil radiates. For example, the coupling efficiency between the power coil and the receiver coil may be approximately 75% to 95%, and generally greater than 70%.

Based on the relatively high coupling efficiency, an amplitude of the electrical current generated by the receiver coil may be relatively high. For example, the amplitude of the electrical current generated by the receiver coil, assuming that the voltage of the electrical source coupled to the power coil is 5 volts (V), may be approximately 25 mA to 100 mA, and generally greater than 0.5 mA. The relatively high amplitude of the electrical current generated by the receiver coil may result in faster battery charging as compared to other techniques that do not generate such electrical current amplitudes.

Some other ear-wearable devices may require mechanical connections as a way to charge the battery, such as a separate socket into which a tip of a cable is inserted for delivering electrical current via contact pins in the socket. Such mechanical connections tend to provide poor connections over time due to wear-and-tear. Also, debris can accumulate in socket, preventing good contact between the cable and the contact pins. With the inductive coupling techniques described in this disclosure, there is little to no mechanical connection, reducing wear-and-tear issues that may be present in other techniques that rely on mechanical connections rather than inductive coupling.

Furthermore, users of ear-wearable devices may already be in the habit of cleaning the vent when there is debris. Therefore, if there is debris in the vent such that it is difficult to insert the power coil, the users may clean the debris using tools and techniques already available to the user to clean the vent and allow for the power coil to be properly inserted. For example, any debris that falls into the tunnel can simply be pushed out one side of the tunnel by inserting any small thin object into the other side of the tunnel.

Some other ear-wearable devices may be configured for inductive coupling to a power source for charging. In such cases, a power source is coupled to an electrical pad that radiates electromagnetic power, and the ear-wearable device includes a receiver coil (not located within the tunnel that forms the vent for allowing internally-generated source to escape) that receives the electromagnetic power. However, in such configurations, the inductive coupling efficiency is relatively poor. Therefore, the amount of electromagnetic power that is coupled to receiver of ear-wearable device is relatively low, resulting in lower amplitude electrical currents and slower battery charging.

Moreover, in these other techniques of inductive charging techniques, the receiver coil of the ear-wearable device requires additional, separate space within the ear-wearable device. This results in design challenges of placing the components within the ear-wearable device within the available space. In some cases, components that may be desirable within the ear-wearable device may not be placed within the ear-wearable device because of lack of sufficient real estate that would be available if the receiver coil were to not take up the real estate.

FIG. 1 illustrates an example ear-wearable device 100. Ear-wearable device 100 may be a hearing aid, earphone, earbud, telephone earpiece, and another type of device designed to be worn on or in a user's ear. As shown in FIG. 1, ear-wearable device 100 includes a shell 102. Shell 102 is molded into a shape that can be worn in an ear of a user. For instance, shell 102 may be molded into a shape suitable for insertion into an ear canal of a user. In some examples, ear-wearable device 100 may be an in-the-ear device and shell 102 may be molded for wear outside an ear canal of a user. In some examples, shell 102 may be custom molded to fit the unique anatomy of an individual user's ear and/or ear canal. In some examples, shell 102 may be made of a flexible material or an elastomer, such as silicone rubber or other flexible material. Shell 102 may have different shapes and styles than that shown in the example of FIG. 1.

Shell 102 has a lateral surface 104 and a medial surface 106. In some examples, lateral surface 104 is a faceplate of ear-wearable device 100. Lateral surface 104 of shell 102 is distal to a midline of the user when ear-wearable device 100 is worn by the user. The midline of the user is considered to be a plane running vertically through the center of the user's body when the user is standing, the plane running from the anterior side of the user's body to the posterior side of the user's body. Medial surface 106 of shell 102 is proximal to the midline of the user when ear-wearable device 100 is worn by the user.

Shell 102 includes a tunnel wall 116. Tunnel wall 116 is a portion of shell 102 shaped to define a tunnel 108 that passes through ear-wearable device 100 from lateral surface 104 to medial surface 106. Tunnel 108 is open at both ends. Thus, tunnel wall 116 defines tunnel 108 such that tunnel 108 has a lateral portal 110 and a medial portal 112. In some examples, tunnel 108 may be a vent that allows internally-generated source to escape from a portion of the user's ear canal medial to ear-wearable device 100 and the outside environment. Thus, in some such examples, shell 102 may be shaped such that during wear of ear-wearable device 100, medial portal 112 of tunnel 108 is located inside an ear canal of the ear of the user. In some examples, shell 102 is shaped such that during wear of ear-wearable device 100, medial portal 112 of tunnel 108 is located in a concha of the ear of the user. Because tunnel 108 is open at both ends, debris may be cleaned from tunnel 108 by pushing the debris out an opposite end of tunnel 108.

As shown in the example of FIG. 1, a tip of cable 114 may be inserted into lateral portal 110 of tunnel 108. As described in greater detail elsewhere in this disclosure, cable 114 includes a power coil at a distal end that inserts within tunnel 108. For instance, receiver coil 118 may be formed in or around tunnel wall 116 of tunnel 108. In FIG. 1, receiver coil 118 is illustrated as being formed within tunnel wall 116 of tunnel 108, but in other examples receiver coil 118 may be formed around tunnel wall 116 of tunnel 108 such as by coils winding around tunnel wall 116.

The power coil at the distal end of cable 114 may inductively couple with receiver coil 118 when cable 114 is inserted into lateral portal 110 of tunnel 108. For example, the power coil may fit into receiver coil 118 such that the coils of the power coil are within the volume generated by the coils of receiver coil 118 (e.g., the power coil is within receiver coil 118). The power coil need not be perfectly within the volume generated by receiver coil 118.

Per vent size (e.g., size of tunnel 108), receiver coil 118 in the ear-wearable device 100 is fixed size and that size determines the resonant frequency the outside coil (e.g., the power coil at the distal end of cable 114) should match. The number of turns determines the matching frequency for maximum efficiency. In some examples, 90% or more coil overlap should be the goal to minimize heat buildup and maintain desired charge rate. For instance, 70% of the coils of the power coil should be within the volume generated by receiver coil 118 (e.g., receiver coil 118 should overlap by 70% or more of the power coil).

Insertion of the power coil into lateral portion 110 of tunnel 108 so that the power coil is inserted through receiver coil 118 causes receiver coil 118 and the power coil to become inductively coupled. For example, when the power coil and receiver coil 118 are inductively coupled, change in electrical current through the power coil induces a voltage across receiver coil 118 and an electrical current to flow through receiver coil 118 through electromagnetic induction.

This may enable a user to use cable 114 to recharge a battery of ear-wearable device 100, exchange data between ear-wearable device 100 and another device, or perform other activities. For example, an electrical power source may be coupled to a proximal end of cable 114 and output an electrical current through cable 114 and through the power coil. The electrical current through the power coil causes electromagnetic power to be radiated and received by receiver coil 118. Receiver coil 118 converts the electromagnetic power to an electrical current that charges the battery. To exchange data, a communication source may output modulated (e.g., amplitude shift keying (ASK)) data through cable 114. In this case, the electromagnetic power that the power coil radiates is based on the modulated data. Receiver coil 118 receives the modulated data, and the electrical current generated by receiver coil 118 is based on the modulated data. Receiver coil 118 may output the electrical current to demodulation circuitry that demodulates the data, and then outputs to processing circuitry for further processing.

To summarize, ear-wearable device 100 comprises a shell 102 shaped for wearing in an ear of a user. Shell 102 comprises tunnel wall 116. Tunnel wall 116 is a portion of the shell shaped to define a tunnel that is open-ended and passes through ear-wearable device 100. Receiver coil 118 is formed in or around tunnel wall 116 of tunnel 108. Receiver coil 118 is configured to inductively couple with a power coil via tunnel 108 and to inductively receive electromagnetic power from the power coil. Receiver coil 118 is configured to convert the electromagnetic power to an electrical current. One or more electrical components encased within shell 102 are configured to receive the electrical current from receiver coil 118.

In one example, the one or more electrical components are configured to transfer the electrical current received from receiver coil 118 to charge the battery. In one example, receiver coil 118 is configured to receive data in the electromagnetic power and convert the electromagnetic power into the electrical current modulated based on the data (e.g., the amplitude and frequency of the electrical current is based on the data). The one or more electrical components are configured to receive the electrical current modulated based on the data and demodulate the electrical current to retrieve the data.

Figure 2:
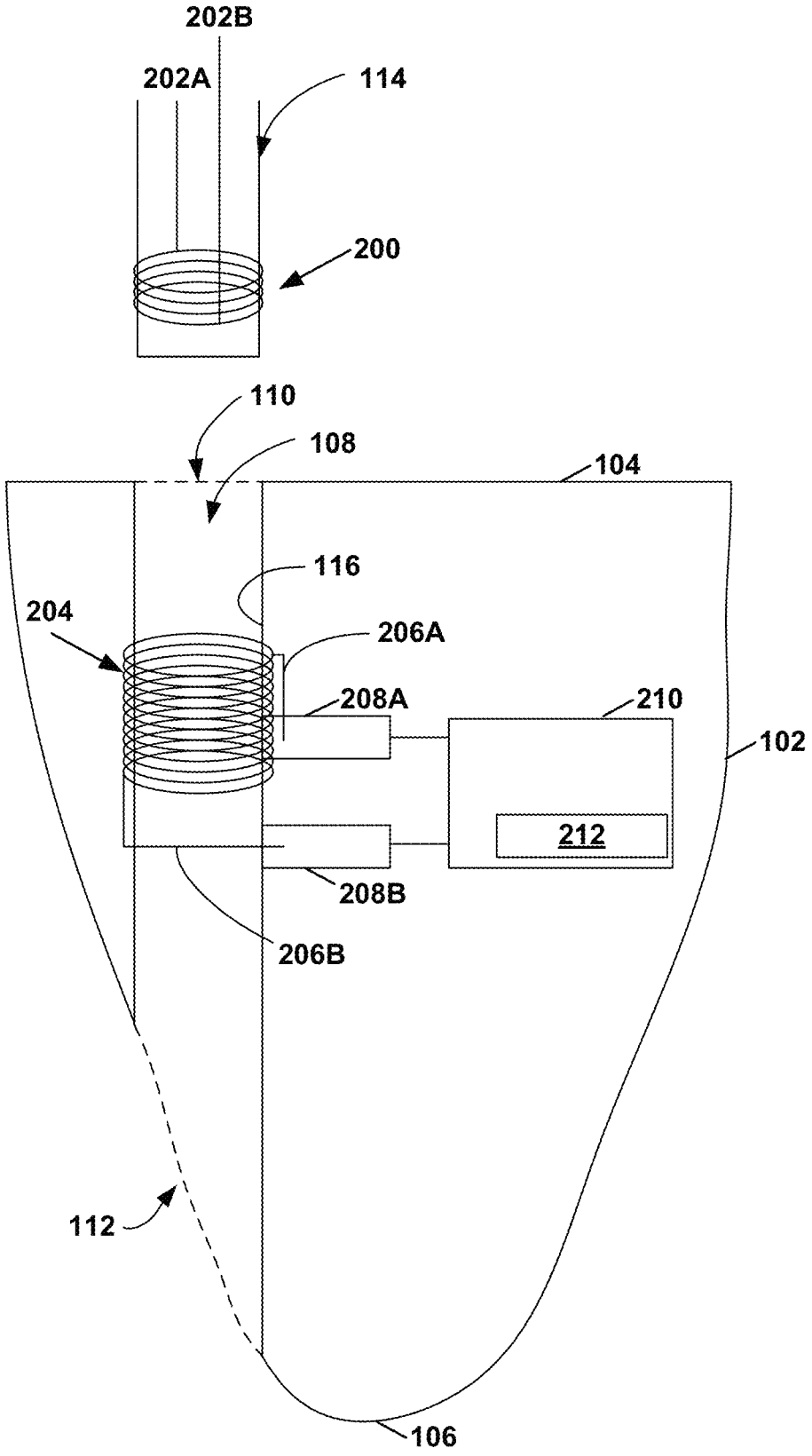
FIG. 2 is a conceptual diagram illustrating an example cross-section of an example ear-wearable device and a cable plug of a cable.

FIG. 2 is a conceptual diagram illustrating an example cross-section of an example ear-wearable device 100 of FIG. 1 and a power coil 200 of cable 114 of FIG. 1. As shown in FIG. 2, power coil 200 includes a plurality of coils that are wrapped around cable 114 or at least a portion of cable 114. In some examples, cable 114, or at least the portion of cable 114 around which the coils of power coil 200 are wrapped, may be formed with material such as ferrite core, air core, or equivalent.

As one example, a wire with material such as copper may be wrapped around a distal portion of cable 114 to form a plurality of coils that together form power coil 200. The number of coils (e.g., turns) may be approximately within a range of 20 and 100. The diameter of the portion of cable 114 around which the wire is warped to form power coil 200 may be 2 mm, and within a range of 1.5 mm to 3.5 mm. The gauge of the wire used to form power coil 200 may be 24 AWG (American Wire Gauge), and the range of the gauge of the wire may be within 20 AWG and 30 AWG.

As illustrated, power coil 200 includes a first connection 202A and a second connection 202B. For instance, in the example where power coil 200 is formed by wrapping a wire around a distal portion of cable 114, first connection 202A is a first end of the wire, and second connection 202B is a second end of the wire. First connection 202A and second connection 202A may be connected to respective power and ground connections of a power source. One or more resistors may be connected in series between first connection 202A and second 202B and the power source to limit the electrical current. As one example, a positive connection of a 5V power source is connected to first connection 202A and a negative connection (e.g., ground connection) of the 5V power source is connected to second connection 202B. The connection causes DC electrical current to flow through power coil 200, which in turn causes electromagnetic power to radiate from power coil 200.

In examples where cable 114 is used to transmit data, first connection 202A and second connection 202B may be coupled to a data source. The data source may output modulated electrical current that represents the data to be transmitted to ear-wearable device 100, and the modulated electrical current may cause power coil 200 to radiate an electromagnetic signal. For instance, the electromagnetic power of the electromagnetic signal may be a function of the modulated electrical current representing the data.

As illustrated, similar to FIG. 1, shell 102 includes tunnel wall 116 that is shaped to define tunnel 108. Tunnel wall 116 may be the tube-shaped portion of shell 102 from lateral portal 110 of tunnel 108 through ear-wearable device 100 to medial portal 112 of tunnel 108.

In the example illustrated in FIG. 2, receiver coil 204 is formed around tunnel wall 116. For example, a wire with material such as copper may be wrapped around tunnel wall 116 to form a plurality of coils that together form receiver coil 204. The number of coils (e.g., turns) may be approximately within a range of 20 to 25 turns, and generally within a range of 15 and 50 turns. The diameter of tunnel 108, defined by tunnel wall 116 around which the wire is warped to form receiver coil 204, may be 2.3 mm, and within a range of 1.8 mm to 4.5 mm. As one example, the diameter of tunnel 108, defined by tunnel wall 116, is within a range of approximately two mm to three mm. In some examples, the thickness of tunnel wall 116 is approximately 0.6 mm, and within a range of 0.4 mm to 1 mm. The gauge of the wire used to form receiver coil 204 may be 24 AWG, and the range of the gauge of the wire may be within 20 AWG and 30 AWG.

As one example, receiver coil 204 may be a silicone incased copper coil wire manufactured to extrude to length and diameter of tunnel 108 defined by tunnel wall 116 that is bonded to shell 102. As described in more detail below, each end of receiver coil 204 (e.g., first connection 206A and second connection 206B) is connected to one or more electrical components 210. As described in more detail with respect to FIG. 4, power coil 200 that supplies power for charging battery 212 may be connected to a universal serial bus (USB) cable (e.g., cable 114 is a USB cable) that is plugged into a USB port of a power source (e.g., USB port of a computer, power adapter, battery pack, wall socket, etc.).

The example illustrated in FIG. 2 shows receiver coil 204 wrapped around tunnel wall 116. However, the example techniques are not so limited. In some examples, receiver coil 204 may be formed within tunnel 108 (e.g., within tunnel wall 116), similar to the example of receiver coil 108 in FIG. 1. Accordingly, a receiver coil (e.g., receiver coil 204 or receiver coil 108) may be formed in (e.g., receiver coil 108) or around (e.g., receiver coil 204) tunnel wall 116 of tunnel 108.

For ease of explanation, one or more example techniques are described with respect to receiver coil 204. However, the example techniques are applicable to receiver coil 108 as well. For instance, the size, number of turns, etc. described above for receiver coil 204 may also represent the size, number of turns, etc. of receiver coil 108.

To ensure protection from debris and water, in some examples, receiver coil 204 may be covered in lacquer or another product such as Teflon (e.g., a Teflon sleeve over receiver coil 204 and/or over power coil 200). To further ensure protection from debris and water, receiver coil 204 may be covered in an acrylic polymer. In this manner, shell 102 can be made waterproof or water-resistance. Thus, in some such examples, ear-wearable device 100 may be submersible, even allowing the user to wear ear-wearable device 100 while swimming or showering.

In the example illustrated in FIG. 2, to charge a battery of ear-wearable device 100 or to transmit data to ear-wearable device 100, a user may insert the distal end of cable 114 having power coil 200 into tunnel 108 defined by tunnel wall 116. The user may insert cable 114 until power coil 200 is within a volume generated by receiver coil 204. The volume generated by receiver coil 204 may be the cylindrical volume within receiver coil 204. For instance, a diameter of receiver coil 204 is larger than a diameter of power coil 200. In some examples, the user may insert cable 114 until power coil 200 fits within receiver coil 204 as a way for power coil 200 to be within the volume generated by receiver coil 204.

Power coil 200 need not necessarily be completely within receiver coil 204. As one example, the user may insert power coil 200 until at least 10% of power coil 200 is within the volume generated by receiver coil 204 (e.g., at least 10% of power coil 200 is overlapped by receiver coil 204). However, because power coil 204 is used to radiate electromagnetic power that receiver coil 204 receives, there may be benefits in ensuring that a substantial (e.g., 80% or greater), including all of, power coil 200 is overlapped by receiver coil 204 (e.g., substantial, including all of, power coil 200 is within the volume generated by receiver coil 204). The more overlap there is between power coil 200 and receiver coil 204, the higher the inductive coupling efficiency there is between power coil 200 and receiver coil 204.

As illustrated, receiver coil 204 includes a first connection 206A and a second connection 206B. For instance, in the example where receiver coil 204 is formed by wrapping a wire in or around tunnel wall 116, first connection 206A is a first end of the wire, and second connection 206B is a second end of the wire. First connection 206A and second connection 206A may be connected to respective electrical pads 208A and 208B of one or more electrical components 210.

As illustrated, one or more electrical components 210 are encased within shell 102. Electrical components 210 may comprise various types of electrical or electronic components. For example, electrical components 210 may include rechargeable battery 212. Examples of battery 212 include rechargeable batteries such as a lithium ion (Li-ion) battery. In some examples, one or more electrical components 210 include a power management integrated circuit (PMIC). The PMIC may be configured to control the flow and direction of electrical power so that electrical current and power can be directed to battery 212 for charging.

For example, ear-wearable device 100 may comprise battery 212 configured to be recharged using electrical energy supplied through power coil 200, received by receiver coil 204, and outputted through first connection 206A and electrical pad 208A and second connection 206B and electrical pad 208B. In such examples, the configuration of electrical pads 208A and 208B may support standard and high-speed charging. In some examples, electrical components 210 include communication units configured to receive information from other computing devices. For instance, in one example, a communication unit may be configured to receive data that configures ear-wearable device 100 for processing sound for a user. In other words, electrical components 210 may comprise circuitry configured to process data transmitted to ear-wearable device 100 through power coil 200, received by receiver coil 204, and outputted through first connection 206A and electrical pad 208A and second connection 206B and electrical pad 208B. In some examples, a communication unit may be configured to receive media data.

In examples where power coil 200 radiates electromagnetic power to charge battery 212, first connection 206A caries the electrical current through electrical pad 208A, through one or more electrical components 210, and back through electrical pad 208B and second connection 206B to form a complete circuit. One or more electrical components 210 may cause electrical current to flow through battery 212 to charge battery 212. For example, one or more electrical components 210 may be configured to transfer the electrical current received from receiver coil 204 to charge battery 212.

Similarly, in examples where power coil 200 radiates electromagnetic power that includes an electromagnetic signal, first connection 206A carries the modulated electrical current through electrical pad 208A, through one or more electrical components 210, and back through electrical pad 208B and second connection 206B to form a complete circuit. One or more electrical components may include demodulation circuitry to demodulate the electrical current and retrieve the data. For instance, receiver coil 204 may be configured to receive data in the electromagnetic power and convert the electromagnetic power into the electrical current modulated based on the data. One or more electrical components 210 may be configured to receive the electrical current modulated based on the data.

As described above, the inductive coupling efficiency between power coil 200 and receiver coil 204 may be relatively high because power coil 200 fits within receiver coil 204 such that power coil 200 and receiver coil 204 are proximate to one another. In addition to allowing for more of the radiated electromagnetic power to be received by receiver coil 204, the increased coupling efficiency may provide additional advantages. For instance, the high coupling efficiency may mean that there is little heating of power coil 200 and receiver coil 204 during the transfer of the electromagnetic power. Because there is little to no heating, it may be possible for the user to keep ear-wearable device 100 within the user's ear while charging the battery or while receiving data. For instance, ear-wearable device 100 is configured to continue operating as a hearing aid while power coil 200 is coupled with receiver coil 204.

In addition to including circuitry to recharge battery 212, one or more electrical components 210 include processing circuitry, communication circuitry, sensing circuitry, and the like. For example, processing circuitry may include a general-purpose processor, digital signal processor (DSP), application specific integrated circuit (ASIC), field-programmable gate array (FPGA), and like including fixed-function and/or programmable circuitry. Sensing circuitry includes sensors to sense body temperature, heart rate, and the like. Communication circuitry includes circuitry to enable ear-wearable device 100 to send and receive data. The communication circuitry includes Bluetooth, 3G, 4G, 4G LTE, ZigBee, WiFi, or another communication technology. In some examples, the communication circuitry may include circuitry that allows ear-wearable device 100 to receive communication via modulated power from power coil 200 received by receiver coil 204, as well as include circuitry that allows ear-wearable device 100 to transmit communication from receiver coil 204 to power coil 200.

The processing circuitry may be configured to perform various example operations. For example, the processing circuitry may process signals generated by a microphone to enhance, amplify, or cancel-out particular channels within the incoming sound, and cause a receiver to generate sound based on the processed signal. As another example, the processing circuitry may receive the signals generated by the sensing circuitry to generate sensor data. For example, the processing circuitry may use signals generated by a body temperature sensor and a heart rate sensor to generate biometric data (e.g., data indicating a body temperature and heart rate of a user of ear-wearable device 100). In another example, the processing circuitry may use signals from one or more accelerometers to generate movement data indicative of movements of ear-wearable device 100.

The processing circuitry may cause the communication circuitry to transmit various types of data. For example, the processing circuitry may cause the communication circuitry to transmit movement data, sensor data, or other types of data. As other examples, the processing circuitry may cause the communication circuitry to transmit information indicating battery life of battery 212.

In some examples, ear-wearable device 100 may utilize receiver coil 204 as a way to communicate. As described in more detail with respect to FIG. 4, in some examples, an external device may output power through power coil 200 and also modulate the power as way to communicate data. Receiver coil 204 receives the modulated power and the PMIC of electrical components 210 may provide the power to recharge battery 212, and the communication circuitry of electrical components 210 may demodulate the data.

In addition, the communication circuitry of electrical components 210 may be configured to output back through receiver coil 204 information. For instance, electrical components 210 may modulate the impedance of receiver coil 204 (e.g., by turning on and off transistors between coils of receiver coil 204). The change in impedance is detected by power coil 200 and the change in impedance is indicative of digital ones and zeros of the data. In this manner, receiver coil 204 may be configured to output modulated data to power coil 200.

Such communication may be useful when battery 212 is being recharged. For instance, in some turbo or rapid charging, a high charge rate is applied for a first few minutes. In this case, the battery voltage of battery 212 may need to be monitored so as to not exceed the maximum allowed level. Processing circuity of electrical components 210 may monitor the charging voltage and cause the communication circuitry to communicate back to the external charging circuit via receiver coil 204 to lower charge rate when a safe upper limit is reached. For Li-Ion batteries, the voltage may be within the range of 4.0 to 4.3 V and even a little higher.

In some examples, rather than communicating by transmitting data through receiver coil 204 and to power coil 200, communication circuitry of one or more electrical components 210 may output through radio communication techniques. Furthermore, communicating the voltage level may provide additional advantages. For instance, based on the battery voltage level, the processing circuitry of one or more electrical components 210 or processing circuitry of an external device may determine the amount of charge present on battery 212 (e.g., 50% full, 70% full, and the like) and/or determine the life of battery 212 before battery 212 needs recharge (e.g., 3 hours to recharge). The external device may then display such information to the user. As one example, the communication would allow for the present battery status to be displayed on the external device to inform the user, directly or indirectly, information about battery 212 (e.g., how much charge, length of battery life, how long until battery is fully charged, etc.).

As described above, in some examples, the processing circuitry may be configured to output information about the user or other information about ear-wearable device 100. As one example, a user smart-phone may be configured to output via radio technology information to the processing circuitry of one or more electrical components 210 when certain people call (e.g., based on phone number), and the processing circuitry may be configured to provide the user with indication of the phone call. As another example, the processing circuitry may be configured to provide the user with information when the temperature of the user is too high. As another example, the processing circuitry may be configured to provide the user with information when the battery level is too low.

In some techniques, the user may receive aural cues when the processing circuitry is trying to communicate information. However, aural cues may be insufficient because due to the user's poor hearing or other ailment (e.g., poor vision), it is possible for the user to miss aural cues. In some examples, ear-wearable device 100 may configured to provide tactile stimulus when the processing circuitry is communicating information. In some examples, the tactile stimulus may be insufficient to provide details of the information (e.g., exact battery level), but may be sufficient to cause the user to recognize that some action is needed (e.g., the user may determine that battery level is too low or temperature is too high). In some examples, it may be possible to convey data through the tactile stimulus.

Figure 6:
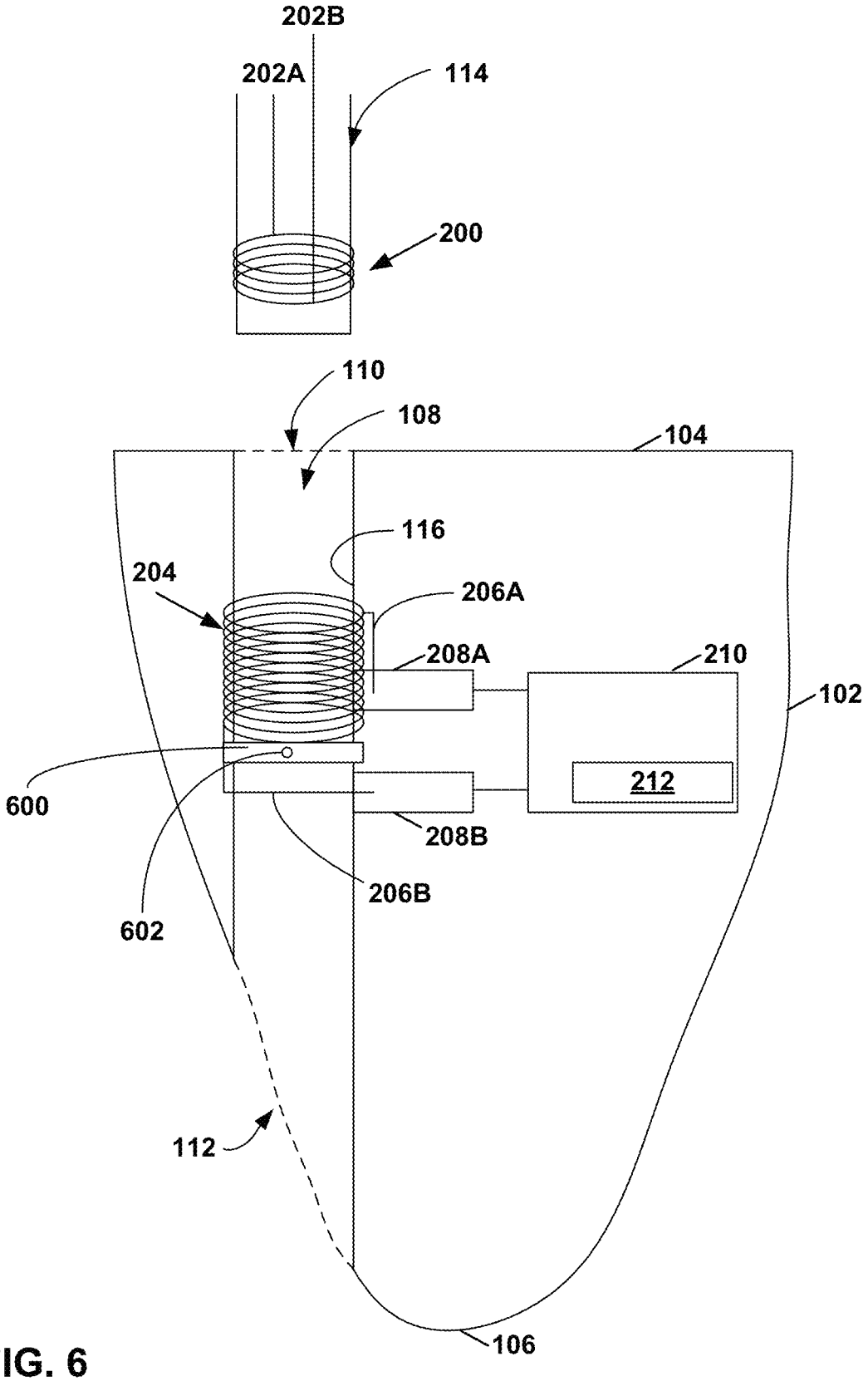
FIG. 6 is a conceptual diagram illustrating an example cross-section of another example ear-wearable device and a cable plug of a cable.

As described in more detail with respect to FIG. 6, in some examples, ear-wearable device 100 includes a moveable object (e.g., magnet) that may oscillate in presence of a current through receiver coil 204. For instance, when the processing circuitry is to communicate information, the processing circuitry may cause a current to flow through receiver coil 204 that causes the moveable object to oscillate. The oscillation causes a "buzzing" sensation to the user providing the tactile stimulus that some action is needed by the user (e.g., battery level is too low, recharge, or someone on your special call list is calling, so pick up phone, etc.).

Figure 3:
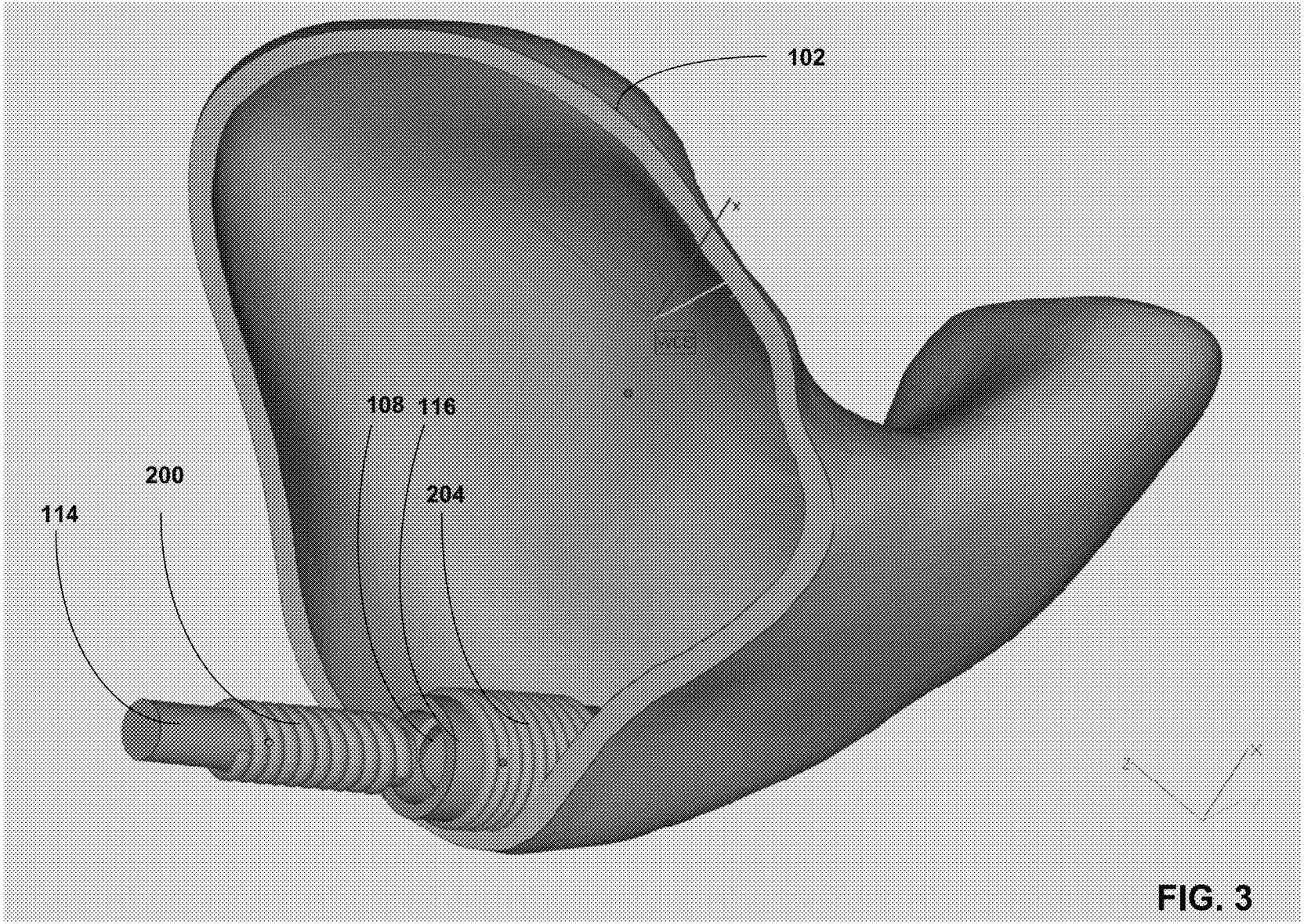
FIG. 3 is a conceptual diagram illustrating an example of a power coil being inserted into a receiver coil of an ear-wearable device.

FIG. 3 is a conceptual diagram illustrating an example of a power coil being inserted into a receiver coil of an ear-wearable device. For instance, FIG. 3 illustrates shell 102. As illustrated, power coil 200 is wrapped, as a series of coils, around the distal end of cable 114. Receiver coil 204 is wrapped, as a series of coils, around tunnel wall 116 that defines tunnel 108. A user may insert power coil 200 into tunnel 108 such that power coil 200 fits within receiver coil 204. In this configuration, power coil 200 and receiver coil 204 may be inductively coupled for transfer of electromagnetic power or signals.

Figure 4:
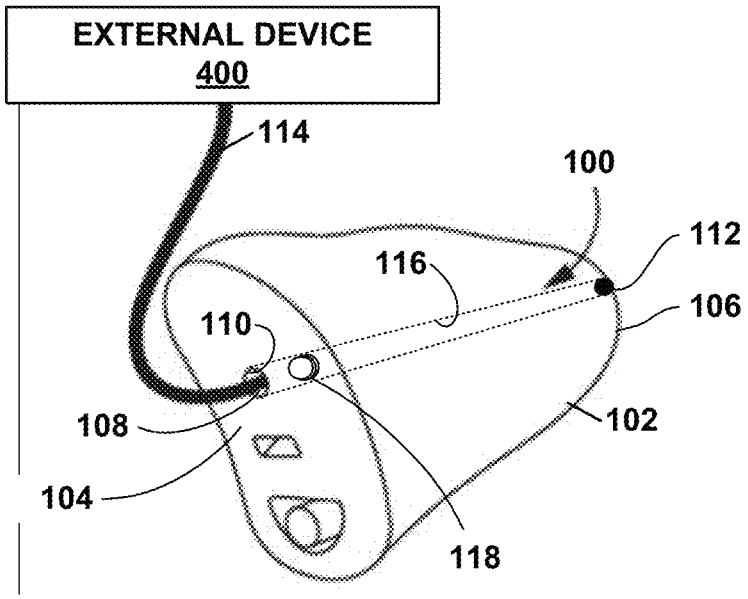
FIG. 4 illustrates an example system comprising an ear-wearable device and an external device in accordance with one or more techniques of this disclosure.

FIG. 4 illustrates an example system comprising ear-wearable device 100 and an external device 400 in accordance with one or more techniques of this disclosure. External device 400 may be a device connected to an end of cable 114 opposite the end inserted into tunnel 108 of ear-wearable device 100. External device 400 may be one of various types of devices. For example, external device 400 may comprise a portable battery back-up device, a smartphone, a media playback device, a media streaming device, a behind-the-ear unit of a RIC hearing aid, or another type of device.

As one example, external device 400 is a circuit that outputs 5V to power coil 200 but other voltage levels are possible. External device 400 may be coupled to a power source, including a computer. For instance, external device 400 couples to a universal serial bus (USB) port of a computer with a USB cable. External device 400 receives power from the computer and converts the power to a 5V output to power coil 200. In some examples, it may be possible for external device 400 to be formed as part of a USB cable. For instance, a first end of the USB cable may be connector for insertion to a USB port (such as that of a computer, but other USB ports, such as in battery packs or wall sockets are contemplated as well). A second end of the USB cable may include external device 400 connected to power coil 200. In this example, cable 114 may be a USB cable having one end that connects into a USB port and the other end includes power coil 200.

As one example, external device 400 may modulate the power signal thus establishing communication link with one or more electrical components 210 (e.g., with recharge circuitry such as PMIC). For instance, external device 400 may provide communication data and power via the same electromagnetic signal. In this example, receiver coil 108 or 204 may receive modulated electromagnetic power (e.g., to simultaneously receive power and communication).

In addition, as described above, receiver coil 108 or 204 may be configured to output modulated data through power coil 200. For example, one or more electrical components 210 may control the impedance of receiver coil 108 or 204, where the impedance at a first level is indicative of a first digital bit level and impedance at a second level is indicative of a second digital bit level. Power coil 200 may sense the change in the impedance due to changes in inductively coupling between power coil 200 and receiver coil 108 or 204. The changes in the inductively coupling may be measured by external device 400 as a way for external device 400 to receive data from ear-wearable device 100.

Having such two-way communication may be beneficial for various reasons. As one example, power coil 200 may output a high current for a few minutes for rapid battery charging. In rapid battery charging, it may be important to ensure that the voltage of battery 212 does not exceed a threshold. One or more electrical components 210 may be configured to measure the voltage level, and output data with receiver coil 108 or 204 to power coil 200, and then to external device 400 indicating if the voltage level is too high. In some examples, external device 400, based on information received through power coil 200 as outputted by receiver coil 108 or 204, may determine battery life of battery 212 and output as display information indicating the battery life (e.g., 50% full), information indicating length of time left for battery life (e.g., 3 hours until recharge is needed), and/or information indicating how long before full charge (e.g., 15 minutes until full charge).

In some examples, a user may continue to use ear-wearable device 100 while power coil 200 is inserted into tunnel 108 and an opposite end of cable 114 is connected to external device 400. For example, ear-wearable device 100 may continue operating as a hearing aid while power coil 200 is inserted into tunnel 108. In another example, ear-wearable device 100 may continue acting as an earphone while power coil 200 is inserted into tunnel 108. Thus, in examples where cable 114 is used for recharging a battery 212 of ear-wearable device 100, the user may continue using ear-wearable device 100 while battery 212 of ear-wearable device 100 is being recharged. This may be an especially useful function when the other end of cable 114 is attached to a portable recharging battery pack. In examples where ear-wearable device 100 acts as an earphone, ear-wearable device 100 may typically receive streams of media data via a wireless antenna. However, when the battery level of rechargeable battery 212 of ear-wearable device 100 is low or there is excessive radio interference, cable 114 may be used to provide either or both energy for both recharging the battery 212 and media data to ear-wearable device 100. For instance, in such an example, ear-wearable device 100 may act like a conventional wired earphone. In such examples, external device 400 may be a smartphone, tablet computer, portable gaming device, or another type of media device.

In some examples, external device 400 comprises a sensor unit. The sensor unit may comprise a device separate from ear-wearable device 100. The sensor unit may include one or more sensors, such as sensors for detecting biological information regarding the user of ear-wearable device 100. For instance, the sensors may include a heart rate sensor, a blood pressure sensor, a transdermal blood oxygenation sensor, or another type of sensor. In some examples, the sensor unit may rest in or be proximate to the user's ear. For instance, the sensor unit may rest in or on the concha, tragus, scapha, or other part of the user's ear. The sensor unit may use cable 114 to communicate data to ear-wearable device 100. Ear-wearable device 100 may store the data from the sensor unit in a memory. In some examples, ear-wearable device 100 may send data from the sensor unit to another device (e.g., a smartphone, personal computer, etc.) wirelessly or via another cable insertable into tunnel 108. In some examples, one or more processors in ear-wearable device 100 may process the sensor data and output audible sound based on the sensor data. For instance, ear-wearable device 100 may alert the user to slow their heart rate.

Figure 5:
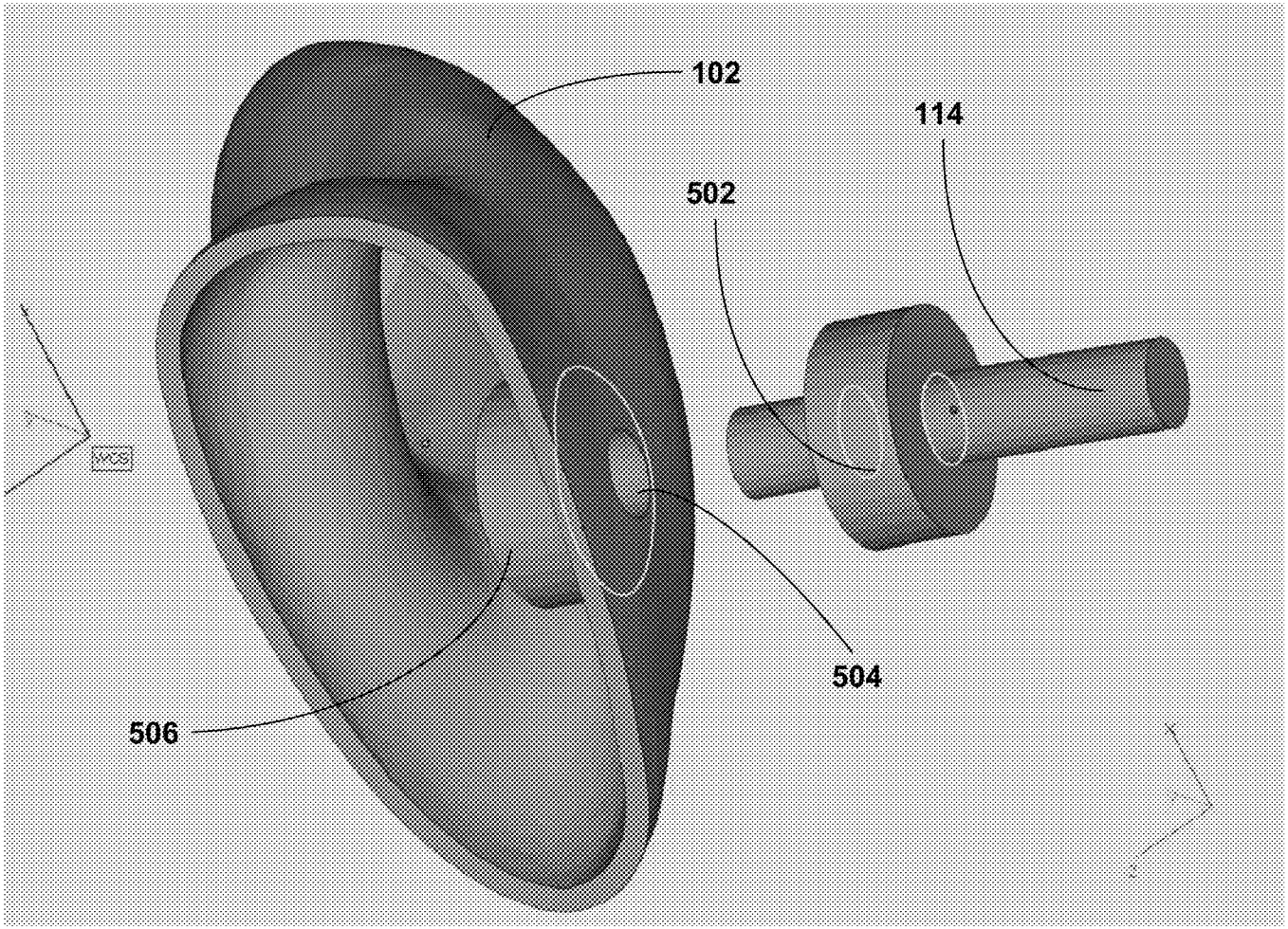
FIG. 5 is a conceptual diagram illustrating an example of a power coil being inductively coupled with a receiver coil of an ear-wearable device.

FIG. 5 is a conceptual diagram illustrating an example of a power coil being inductively coupled with a receiver coil of an ear-wearable device. In the above examples, receiver coil 118 is described as being formed in tunnel wall 116 that defines tunnel 108, and receiver coil 204 is formed around tunnel wall 116 that defines tunnel 108. However, the example techniques are not so limited.

FIG. 5 illustrates tunnel 504 that is defined by a tunnel wall in shell 102. The location of tunnel 504 relative to shell 102 is provided as one example and should not be considered as limiting. In this example, receiver coil 506 is lateral to the tunnel wall that defines tunnel 504. For instance, to be lateral in this example, receiver coil 506 is formed on the inside of shell 102 such that the coils of receiver coil 506 extend substantially perpendicular and no coil of receiver coil 506 is in tunnel 504 or in the tunnel wall that defines tunnel 504.

In this example, the distal end of cable 114 may include a peg, such as an alignment peg. Power coil 502 may be located proximate to or at the distal end of the peg. The peg may be inserted into tunnel 504 to allow power coil 502 and receiver coil 506 to be inductively coupled. In some examples, the circumference of the peg may be approximately 2 mm, and tunnel 504 may be slightly bigger.

When the peg is inserted, power coil 502 abuts on one side of shell 102, and receiver coil 506 abuts on the other side of shell 102, such that power coil 502 (e.g., outside coil) and receiver coil 506 (e.g., inside coil) are side-by-side. In some examples, it may be possible that the size of tunnel 504 is large enough to allow power coil 502 to be encompassed by receiver coil 506 when the peg is inserted.

FIG. 6 is a conceptual diagram illustrating an example cross-section of another example ear-wearable device 100 and a cable plug of a cable. FIG. 6 is similar to FIG. 2, except FIG. 6 further illustrates a movable object 600 near the end of receiver coil 204.

In one or more examples, object 600 may be configured to provide the user with tactile stimulus for indicating a status. As described above, the user may desire to know status information such as body temperature, whether battery life of battery 212 is too low, whether someone on a special phone number list is calling, etc. Providing aural cues for the status information may be insufficient because the user may have poor hearing or vision. Having a tactile stimulus along with aural cues (or separate from aural cues) may more likely be detected by the user.

For example, object 600 may be a magnet, with a north side and a south side, with the center of object 600 being pivot point 602. Object 600 may be formed with neodymium, which is one of the strongest commercially available magnets (NdFeB) (Neodymium, iron, boron). Object 600 may 3 to 4 mm in length by 1 mm by 1 mm rectangular bar, or 3 mm to 4 mm length by 1.5 mm diameters for cylindrical magnet.

When current flows through receiver coil 204, the current causes object 600 to oscillate along pivot point 602. The amplitude of the current may be in the 10s of milliamps. One or more electrical components 210 may inject an alternating current into receiver coil 204, which creates an alternating field which interacts with object 600. Half of object 600 is "pulled" and the other half is "pushed" along pivot point 602. This oscillation of moveable object 600 is felt like a buzz sensation by the user indicating the status information (e.g., battery level too low, call from someone on special list of phone numbers, temperature too high, etc.).

In some examples, the amplitude and/or frequency of the current through receiver coil 204 may set the oscillation frequency of moveable object 600. The user may feel the different oscillations (e.g., fast buzzing sensation for fast oscillation, slow buzzing sensation for slow oscillation). Accordingly, it may be possible to convey additional information based on the oscillation of object 600. For instance, if battery too low is to be conveyed, one or more electrical components 210 may output a current having low frequency resulting in slow oscillation. If high temperature is to be conveyed, one or more electrical components 210 may be output a current having high frequency resulting in high oscillation. In this manner, receiver coil 204 may perform multiple duties: recharging, communicating, and providing tactile stimulation.

The above configuration of object 600 is one example, and there may be other configurations as well. For instance, object 600 may be a disk shape that forms as a valve for tunnel 108. Some example benefits of having a valve, such as a butterfly valve, are described in U.S. Pat. No. 8,923,543. In some examples, it may be possible move object 600, having the disk shape, to rotate in such a manner to open or close tunnel 108. In this example, object 600 may be configured to oscillate back and forth (e.g., with current through receiver coil 204) creating a tactile stimulus in addition to functioning as a valve for tunnel 108.

Various examples have been described. These and other examples are within the scope of the following claims.

What is claimed is:

1. An ear-wearable device comprising:

a shell shaped for wearing in an ear of a user, wherein the shell comprises a tunnel wall that defines a tunnel;

a receiver coil that is formed in or around the tunnel wall of the tunnel, wherein the receiver coil is configured to inductively couple with a power coil via the tunnel and to inductively receive electromagnetic power from the power coil, and wherein the receiver coil is configured to convert the electromagnetic power to an electrical current; and one or more electrical components encased within the shell and configured to receive the electrical current from the receiver coil.

2. The ear-wearable device of claim 1, further comprising a battery, wherein the one or more electrical components are configured to transfer the electrical current received from the receiver coil to charge the battery.

3. The ear-wearable device of claim 1, wherein the receiver coil is configured to receive data in the electromagnetic power and convert the electromagnetic power into the electrical current modulated based on the data, and wherein the one or more electrical components are configured to receive the electrical current modulated based on the data.

4. The ear-wearable device of claim 1, wherein the tunnel is a tunnel that is open-ended and passes through the ear-wearable device.

5. The ear-wearable device of claim 1, wherein:

the tunnel is a vent, and the shell is shaped such that during wear of the ear-wearable device, a medial portal of the tunnel is located inside an ear canal of the ear of the user.

6. The ear-wearable device of claim 1, wherein a diameter of the receiver coil is larger than a diameter of the power coil, and wherein to inductively couple, the power coil fits within the receiver coil.

7. The ear-wearable device of claim 1, wherein a diameter of the receiver coil is within a range of approximately two millimeters (mm) to three mm.

8. The ear-wearable device of claim 1, wherein the receiver coil is formed by a metal that is covered in lacquer, and further covered in a Teflon sleeve.

9. The ear-wearable device of claim 1, wherein a number of turns in the receiver coil is within a range of approximately 20 to 50 turns.

10. The ear-wearable device of claim 1, wherein:

the shell comprises a faceplate and a shell component, the shell component is shaped to define an interior cavity containing the one or more electrical components, the faceplate is shaped to cover an opening of the interior cavity, and the tunnel is formed through the faceplate and the shell component.

11. The ear-wearable device of claim 1, wherein the ear-wearable device is configured to continue operating as a hearing aid while the power coil is coupled with the receiver coil.

12. The ear-wearable device of claim 1, wherein:

the shell has a lateral surface and a medial surface, the lateral surface of the shell is distal to a midline of the user when the ear-wearable device is worn by the user, the medial surface of the shell is proximal to the midline of the user when the ear-wearable device is worn by the user, and the tunnel passes through the ear-wearable device from the lateral surface of the shell to the medial surface of the shell and is open at both the lateral surface of the shell and the medial surface of the shell.

13. The ear-wearable device of claim 1, wherein to inductively receive electromagnetic power, the receiver coil is configured to receive modulated electromagnetic power, and wherein the receiver coil is configured to output modulated data to the power coil.

14. The ear-wearable device of claim 1, further comprising:

a moveable object, wherein a current through the receiver coil causes the moveable object to oscillate providing the user with a tactile stimulus for indicating a status.

* * * * *